US005803075A

United States Patent [19]

Yavitz

[11] Patent Number: 5,803,075

[45] Date of Patent: Sep. 8, 1998

[54] SURGICAL MASK WITH ADHESIVE STRIP TO IMPROVE BREATHING

[75] Inventor: Edward Q. Yavitz, Rockford, Ill.

[73] Assignee: Yaru LLC, Wilmington, Del.

[21] Appl. No.: 616,813

[22] Filed: Mar. 15, 1996

[51] Int. Cl.[6] ..... A62B 18/02; A62B 18/08

[52] U.S. Cl. ..... 128/206.25; 128/206.24; 128/206.28; 128/201.17; 128/206.21; 128/207.11

[58] Field of Search ..... 128/206.25, 201.17, 128/206.16, 206.24, 206.21, 206.28, 207.11

[56] References Cited

U.S. PATENT DOCUMENTS 4,635,628 1/1987 Hubbard et al. .
4,673,084 6/1987 Hubbard et al. .
5,533,499 7/1996 Johnson .
5,533,503 7/1996 Doubek et al. .
5,546,929 8/1996 Muchin .
5,549,103 8/1996 Johnson .
5,561,863 10/1996 Carlson, II .

*Primary Examiner*—Mickey Yu
*Assistant Examiner*—Dinh X. Nguyen
*Attorney, Agent, or Firm*—Fletcher, Yoder & Edwards

[57] ABSTRACT

A surgical mask for covering a nose and mouth of a person is disclosed. The mask is designed to facilitate the flow of air through the nose. The mask includes a stiff, adhesive strip which, when secured over the nose, opens the nasal passages to allow more air to flow therethrough. In addition, the stiff, adhesive strip prevents exhaled air from escaping through the top of the mask and condensing on the wearer's glasses or other surfaces.

19 Claims, 2 Drawing Sheets

FIG. 1
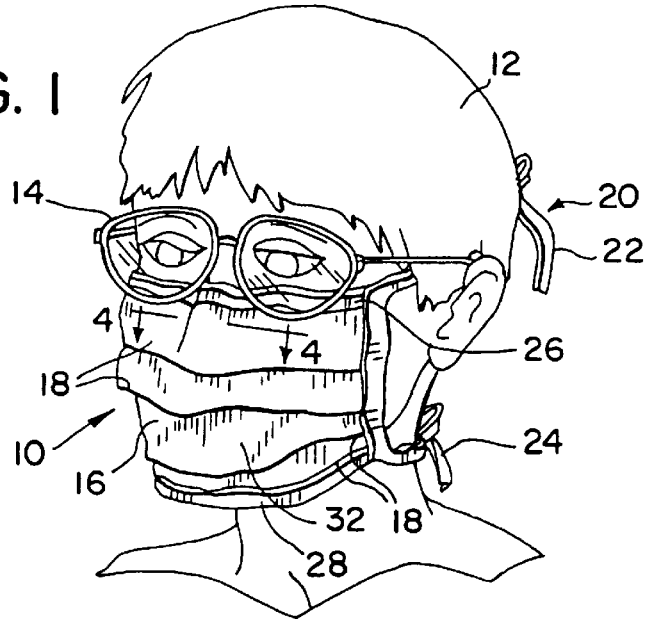
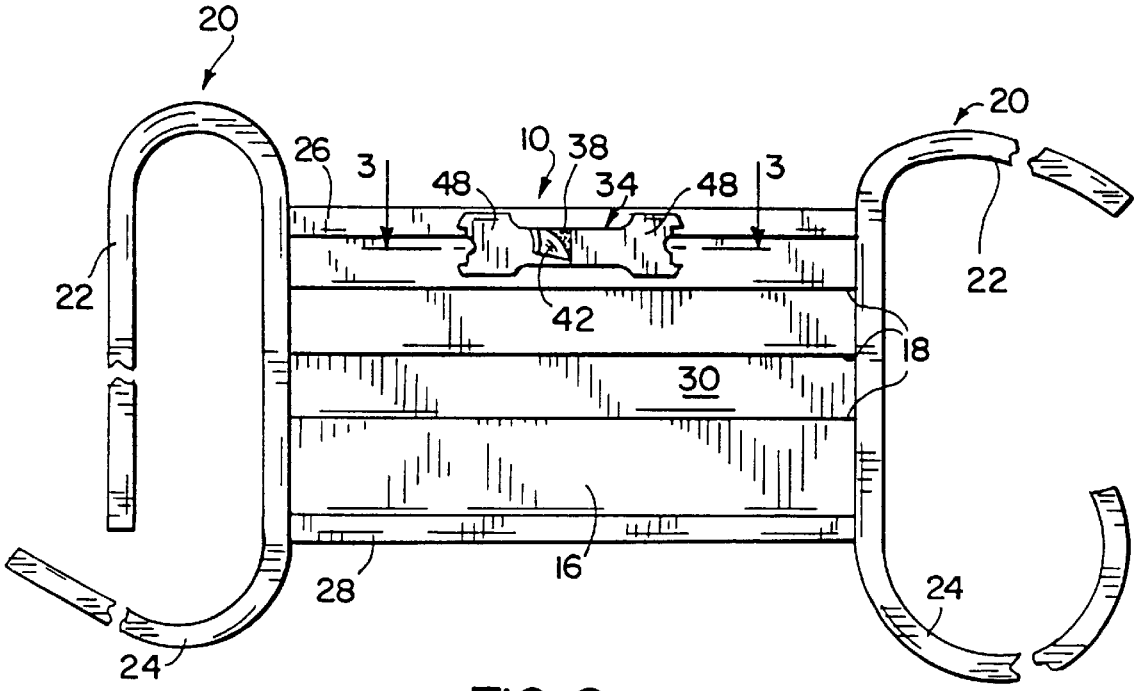
FIG. 2

SURGICAL MASK WITH ADHESIVE STRIP TO IMPROVE BREATHING

FIELD OF THE INVENTION

The present invention relates generally to a mask for covering a nose and mouth of a wearer, and particularly to a surgical mask that improves the flow of air to the wearer and limits the escape of air and vapor from the top of the mask.

BACKGROUND OF THE INVENTION

Doctors wear disposable, surgical masks while in the operating room to prevent the spread of germs during surgery. Typical surgical masks consist of an expandable, air-permeable filter and two sets of straps. The mask is secured over the nose and mouth of the wearer by tying the two sets of straps around the head and neck of the wearer. The mask also contains at least one thin, metal band that extends along the top edge of the mask. The band is pressed down around the nose of the wearer to achieve a better fit when the mask is worn.

Because doctors often wear surgical masks for extended periods of time, surgical masks must be comfortable and not frustrate the ability of the wearer to perform. The masks should also be cheap since they are disposed of after a single use. Typical surgical masks may be uncomfortable because the metal band pinches the nose of the wearer. Moreover, by compressing the nose, the band restricts the flow of air through the nose, making it more difficult for the wearer to breathe.

Surgical masks present additional problems for doctors who wear glasses or who work with operating microscopes. There is an increased discomfort in having glasses rest atop a surgical mask with a metal band already pinching the nose. In addition, because the metal band does not prevent the escape of air from the top of the mask, exhaled air may depart from the top of the mask and condense on the glasses of the wearer or the oculars of a microscope, obstructing the wearer's view.

One solution involves the application of surgical tape over the top edge of the mask to form an airtight seal between the mask and the nose and cheeks of the wearer. However, applying the surgical tape to the mask requires additional preparation time and increases the discomfort for the wearer, because the tape must extend upward from the surgical mask and closer to the eyes of the wearer.

Another approach, such as that disclosed in Hubbard et al., U.S. Pat. No. 4,635,628, utilizes a laminate moisture barrier in conjunction with a metal band to restrict the escape of vapor from the top of the mask. One disadvantage with combining the laminate moisture barrier and the metal band is the increased bulk that a wearer with glasses must tolerate. The added features also raise the cost of the mask because of the price of the parts and the increased manufacturing time. Furthermore, like the metal bands in typical surgical masks, this band pinches the nose of the wearer, restricting the flow of air through the nose. A similar approach involves coating an interior upper surface of the mask with a tacky material. The tacky material in combination with a metal band help hold the mask to the wearer's face. However, this approach entails many of the same problems of restricted air flow, complexity and cost of manufacture.

It would be advantageous to have a cheap, comfortable, surgical mask that covers the nose and the mouth of the wearer, enhances the flow of air through the nose, and prevents the escape of exhaled air from the top of the mask.

SUMMARY OF THE INVENTION

The present invention features a surgical mask designed to enhance the flow of air through the nose of the wearer. The mask includes a filter made of an air-permeable material and having an inner surface designed to contact the face of the wearer when the mask is worn. The filter includes several folds that expand outward when the mask is placed over the nose and mouth of the wearer. The mask also includes several connectors, such as straps, which when fastened about the head and neck secure the mask over the nose and mouth of the wearer.

In addition, the inner surface of the filter includes a strip that is stiff and resilient to provide a bias towards its original position once bowed. The stiff, adhesive strip is mounted on a top edge of the inner surface and includes an adhesive layer disposed for contact with the wearer's nose. Because the adhesive strip is designed to affix the top edge of the filter to the nose of the wearer, there is no need for metal bands to shape the mask over the nose. The stiff, adhesive strip gently pulls up on the nose, opening the nasal passages to allow air to flow more freely. Furthermore, the adhesive strip prevents exhaled air from escaping through the top edge of the filter and condensing on glasses or other surfaces.

BRIEF DESCRIPTION OF THE DRAWINGS

The invention will hereafter be described with reference to the accompanying drawings, wherein like reference numerals denote like elements, and:

FIG. 1 is a perspective view of a surgical mask according to a preferred embodiment of the present invention as it appears when worn by a person;

FIG. 2 is a back view of the surgical mask illustrated in FIG. 1.

DETAILED DESCRIPTION OF THE PREFERRED EMBODIMENT

Figure 3:
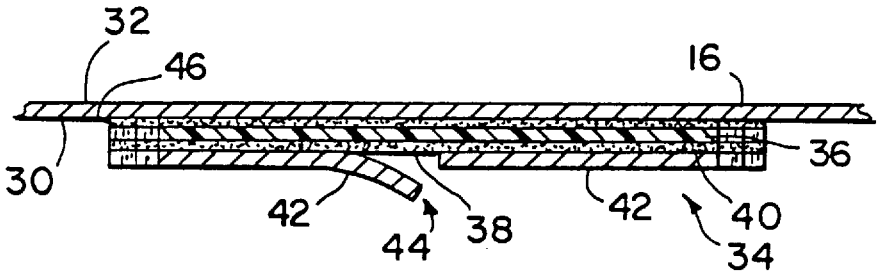
FIG. 3 is a cross-sectional view of the surgical mask taken generally along line 3—3 of FIG. 2.

Referring generally to FIG. 1, a surgical mask 10 according to a preferred embodiment of the invention is illustrated on a wearer 12 having a pair of glasses 14. Mask 10 includes an air-permeable filter 16 designed to cover the nose and mouth of wearer 12. Filter 16 has a plurality of folds 18 which enable filter 16 to extend outward over the contours of the wearer's face. Mask 10 also includes a fastener and preferably a plurality of fasteners 20 which can be used to secure mask 10 over the face of the wearer. In the illustrated embodiment, fasteners 20 include an upper pair of tie straps 22 and a lower pair of tie straps 24 that extend from top edge 26 and bottom edge 28 of mask 10, respectively. When mask 10 is worn, tie straps 22, 24 are secured around the head and the neck of wearer 12.

Figure 4:
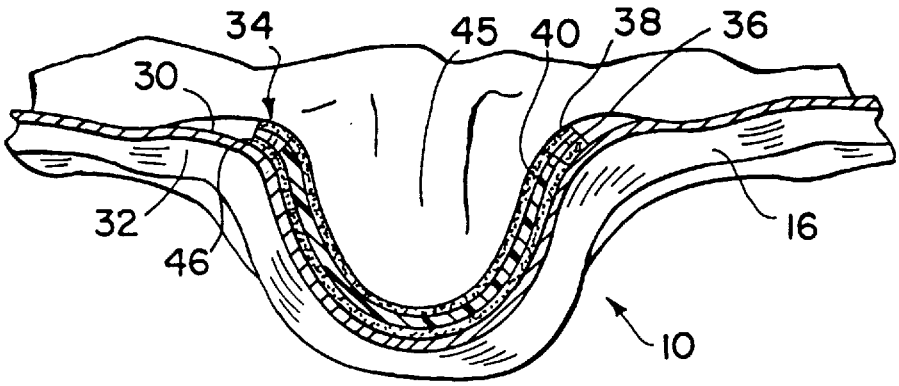
FIG. 4 is a cross-sectional view of the surgical mask taken generally along line 4—4 of FIG. 1.

As illustrated in FIGS. 2–4, filter 16 has an inner surface 30 and an outer surface 32. A strip 34 is attached to inner surface 30, preferably proximate top edge 26. Strip 34 can extend along the entire top edge 26, but it preferably extends only a portion of that distance and is centered along top edge 26 between the sides of mask 10.

Strip 34 includes a resilient layer 36 that biases strip 34 back towards its original configuration once strip 34 is bowed or bent. Resilient layer 36 can be made from a variety of flexible yet resilient materials, such as stiff paperboard or plastic. Strip 34 further includes a layer of adhesive 38 applied to an inner surface 40 of resilient layer 36.

Strip 34 further includes a peelable backing material 42 applied to the layer of adhesive 38 to prevent its contamination with dust, lint, or other particles that can have a detrimental effect on its stickiness. Preferably, peelable backing material 42 has a central split region 44 as illustrated in FIG. 3. Thus, each half of peelable backing material 42 can be peeled away from layer of adhesive 38 prior to applying strip 34 to the nose 45 of wearer 12 as illustrated in FIG. 4.

Strip 34 can be attached to inner surface 30 in a variety of ways, including stitching and adhesives. However, strip 34 is preferably affixed to inner surface 30 via an adhesive layer 46 that securely holds strip 34 in position against filter 16. Thus, strip 34 remains securely attached to inner surface 30 when filter 16 and strip 34 are bent or bowed around the nose 45 of wearer 12 as illustrated best in FIG. 4.

Once applied, layer of adhesive 38 retains strip 34 and filter 16 in position against the wearer's nose and prevents any upward air flow past nose 45 of wearer 12 that would otherwise interfere with the wearer's glasses 14. Meanwhile, resilient layer 36 biases strip 34 and filter 16 back towards their original position, thus gently pulling the nose upwardly and outwardly to open the nasal passages. As a result, strip 34 improves the flow of air through the wearer's nose, helping the wearer to breath easier.

Additionally, strip 34 preferably includes an expanded region 48 at each end, as best illustrated in FIG. 2. Expanded regions 48 facilitate adherence of strip 34 to the nose of wearer 12, and thus help open the nasal passages.

A variety of materials can be used in the construction of strip 34. In fact, resilient layer 36 can be designed with differing degrees of stiffness, i.e., resiliency, to permit wearer 12 to choose mask 10 according to his or her preference. An exemplary strip 34 is the Breathe Right™ external nasal dilator, manufactured by CNS, Inc. located in Chanhassen, Minn. 55317. The Breathe Right™ external nasal dilator has a resilient layer that is covered by a layer of adhesive designed to stick to the wearer's nose. The resilient layer spreads the wearer's nose to facilitate breathing. Additionally, the Breathe Right™ external nasal dilator includes peelable backing material that protects the layer of adhesive, but can be easily peeled away prior to application to the wearer's nose.

It will be understood that the foregoing description is of a preferred exemplary embodiment of this invention and that the invention is not limited to the specific forms shown. For example, a variety of filter materials and fasteners can be used on the mask. Additionally, the mask can be constructed with conventional folds or without according to the particular application. The length of the strip as well as its resiliency can be changed according to the particular application or to provide a wider selection of masks for the user. These and other modifications may be made in the design and arrangement of the elements without departing from the scope of the invention as expressed in the appended claims.

What is claimed is:

1. A mask for use by a person conducting a surgical procedure, the mask comprising:

an air-permeable filter having a top edge and a bottom edge, the air-permeable filter further including an inner surface designed to cover a nose and mouth of a wearer;

a plurality of fasteners mounted at the top edge and the bottom edge of the filter, the plurality of fasteners being configured to secure the mask about the face of a wearer; and a strip attached to the air-permeable filter along the top edge of the inner surface, the strip including a resilient layer and an adhesive layer designed to stick to a nose of the wearer, the resilient layer biasing the strip back towards its original position after being applied to a nose, thereby opening the nasal passages of the wearer.

2. The mask as recited in claim 1, wherein the air-permeable filter has a plurality of folds designed to expand when the mask is worn.

3. The mask as recited in claim 2, wherein the plurality of fasteners are straps.

4. The mask as recited in claim 3, wherein the strip is attached to the filter by an adhesive.

5. A surgical mask to facilitate breathing, the surgical mask comprising:

an air-permeable filter having a top edge, a bottom edge and an inner surface, the inner surface being configured to cover a nose and mouth of a wearer;

a fastener mounted on the air-permeable filter, the fastener being designed to secure the mask about the face of a wearer; and a strip centrally disposed along the top edge of the inner surface of the air-permeable filter, the strip including a resilient layer and an adhesive, the resilient layer and the adhesive cooperating to stick to a wearer's nose and bias the nasal passages towards a more open position.

6. The surgical mask as recited in claim 5, wherein the air-permeable filter has a plurality of folds designed to expand over a nose and mouth when the mask is worn.

7. The surgical mask as recited in claim 6, wherein the plurality of fasteners are straps.

8. The surgical mask as recited in claim 7, wherein the strip includes a backing layer disposed over the adhesive.

9. The surgical mask as recited in claim 5, wherein the resilient layer comprises a plastic material.

10. The surgical mask as recited in claim 5, wherein the resilient layer comprises a paperboard material.

11. The surgical mask as recited in claim 5, wherein the strip has a pair of expanded ends.

12. The surgical mask as recited in claim 5, wherein the strip comprises a Breathe Right™ external nasal dilator.

13. A method for constructing a mask, comprising the steps of:

preparing an air-permeable filter having a top edge, a bottom edge, an outer surface and an inner surface;

attaching a fastener to the air-permeable filter to selectively hold the air permeable filter over the nose and mouth of a wearer;

affixing a resilient strip to the inner surface of the air-permeable filter, the resilient strip being capable of providing a biasing force towards its original position when bowed; and applying an adhesive layer to an inner surface of the resilient strip.

14. The method as recited in claim 13, further comprising the step of applying a backing layer to the adhesive layer.

15. The method as recited in claim 14, wherein the fastener is a plurality of straps.

16. The method as recited in claim 15, wherein the step of preparing the air-permeable filter includes the step of providing folds in the air permeable filter.

17. The method as recited in claim 14, further comprising the steps of removing the backing layer and pressing the adhesive layer against a nose of a wearer.

18. The method as recited in claim 13, wherein the resilient layer comprises plastic.

19. The method as recited in claim 13, wherein the resilient layer comprises a paperboard material.

* * * * *